US009155448B1

(12) United States Patent
Gabbay

(10) Patent No.: US 9,155,448 B1
(45) Date of Patent: Oct. 13, 2015

(54) PORTABLE WASHING AND DRYING APPARATUS

(71) Applicant: Niloufar Gabbay, Los Angeles, CA (US)

(72) Inventor: Niloufar Gabbay, Los Angeles, CA (US)

( * ) Notice: Subject to any disclaimer, the term of this patent is extended or adjusted under 35 U.S.C. 154(b) by 0 days.

(21) Appl. No.: 14/727,744

(22) Filed: Jun. 1, 2015

(51) Int. Cl.

| | |
|---|---|
| ***A47L 17/02*** | (2006.01) |
| ***A47L 19/04*** | (2006.01) |
| ***A47B 73/00*** | (2006.01) |
| ***A47B 43/00*** | (2006.01) |

(52) U.S. Cl.
CPC ..... *A47L 19/04* (2013.01); *A47B 43/00* (2013.01); *A47B 73/00* (2013.01); *A47L 17/02* (2013.01)

(58) Field of Classification Search
CPC ..... A47B 33/00; A47B 43/00; A47B 73/00; A47B 73/002; A47J 43/24; A47J 47/20; A47K 1/04; A47K 1/05; A47K 1/06; A47L 17/00; A47L 17/02; A47L 19/00; A47L 19/02; A47L 19/04; E03C 1/181; E03C 1/186; E03C 1/267
USPC ..... 211/41.3, 41.4, 41.5, 41.6; 220/486, 220/487, 488; 4/631–636, 652, 654, 656, 4/657, 658, 659; 134/115 R
See application file for complete search history.

(56) References Cited

U.S. PATENT DOCUMENTS

| | | | | | |
|---|---|---|---|---|---|
| 431,943 | A * | 7/1890 | Gaugh | 134/92 |
| 815,855 | A * | 3/1906 | McAdams | 211/41.6 |
| 916,283 | A * | 3/1909 | Eccleston | 4/656 |
| 1,363,590 | A * | 12/1920 | Hasskarl | 220/572 |
| 1,368,591 | A * | 2/1921 | Windsor | 4/644 |
| 1,379,152 | A * | 5/1921 | Windsor | 4/655 |
| 1,688,654 | A * | 10/1928 | Quant | 134/165 |
| 1,810,855 | A * | 6/1931 | Rockmore | 220/487 |
| 2,173,096 | A | 9/1939 | Campbell | |
| 2,419,040 | A | 4/1947 | Stepanian | |
| 2,535,967 | A * | 12/1950 | Thiermann | 4/656 |
| 3,144,159 | A * | 8/1964 | Varkala | 220/6 |
| 4,894,875 | A | 1/1990 | Oxley | |
| 5,485,859 | A * | 1/1996 | Johnson et al. | 134/115 R |
| 5,492,237 | A | 2/1996 | Chang | |
| 5,815,856 | A * | 10/1998 | Dore | 4/657 |
| D417,052 | S | 11/1999 | Ancona | |
| 6,283,314 | B1 | 9/2001 | Loguercio | |
| 6,758,348 | B2 | 7/2004 | Adkins | |
| 7,669,721 | B2 | 3/2010 | Kemper | |
| 7,678,271 | B2 | 3/2010 | Curtin | |
| 7,735,661 | B1 * | 6/2010 | Sumner et al. | 211/41.3 |
| 8,961,786 | B1 * | 2/2015 | Farmer | 210/236 |
| 2003/0080074 | A1 * | 5/2003 | Adkins | 211/41.6 |
| 2006/0292343 | A1 | 12/2006 | Sellers | |

(Continued)

*Primary Examiner* — Joshua Rodden
(74) *Attorney, Agent, or Firm* — Trojan Law Offices

(57) ABSTRACT

A portable washing and drying apparatus useful for washing and drying baby bottle components and other baby-feeding accessories in limited spaces. The apparatus has a flexible membrane to place baby-feeding accessories so that the apparatus can lie in sink basins that have a variety of sizes and shapes. The membrane has a plurality of interspersed holes and a plurality of projections to hold accessories. The membrane may have vertical partitions that separate the flexible membrane into drying and washing regions. The membrane is supported by at least two frame members secured to opposing sides of the membrane and can be spatially adjusted from each other. In one configuration, the frame members have hooks that extend therefrom and attach to an external support, such as a towel bar. In another configuration, the frame members are connected by a chain and hook, so that the apparatus can hang from a shower rod.

18 Claims, 3 Drawing Sheets

(56) References Cited

U.S. PATENT DOCUMENTS

2007/0251874 A1 11/2007 Stewart
2008/0210648 A1* 9/2008 Davis ..... 211/41.3
2009/0104811 A1 4/2009 Sumida
2011/0274807 A1 11/2011 Haber
2014/0263111 A1 9/2014 Micek

* cited by examiner

PORTABLE WASHING AND DRYING APPARATUS

CROSS REFERENCE TO RELATED PATENT APPLICATIONS

None.

FIELD OF THE INVENTION

This invention relates to a portable washing and drying apparatus. In particular, this invention relates to a flexible, collapsible, and hangable rack that allows for sanitary washing and air-drying of multiple articles, such as baby bottles, in areas where there is limited space.

BACKGROUND OF THE INVENTION

The ability to wash and dry baby feeding articles (such as baby bottles) in a sanitary manner is of utmost importance to parents. Traveling with children poses numerous difficulties in the ability to effectively wash and dry baby feeding articles. There is often no kitchen available and bathrooms while traveling are both limited in space and unsanitary. Parents who travel with young children subsequently need to use a bathroom sink and countertop to wash and dry feeding articles such as bottles, Sippy cups, pacifiers, small plates and bowls, and utensils. Further, baby feeding articles, such as bottles, have many parts. Often there is not ample space in or around a bathroom sink to wash and dry the articles properly. Drying baby feeding articles on an often limited countertop occupies valuable counter space.

From a sanitary standpoint, washing and drying baby feeding articles is problematic. Bathroom sinks may not be sanitary and parents may be reluctant to place baby feeding articles in an unsanitary sink during the washing process. Bathrooms are known to harbor bacteria, and it is known that bacteria from toilets can transfer to bathroom sponges, countertops, and sinks. One may try to cover a contaminated area such as a bathroom countertop with a towel when drying feeding articles, but towels do not drain water well and also may harbor bacteria.

There have been various attempts to facilitate washing and drying of baby supplies in a limited space. For example, drying racks with hooks for hanging have been proposed, such as U.S. Pat. No. 5,492,237 to Chang, U.S. Pat. No. D417052 to Ancona, and U.S. Pat. No. 6,758,348 to Adkins Drying racks have also been proposed that are collapsible, such as U.S. Pat. No. 6,283,314 to Loguercio, and U.S. Patent Application Pub. No. 20140263111 to Micek. Straining devices, such as colanders, have also been proposed to aid in air-drying of articles, such as U.S. Pat. No. 7,678,271 to Curtin, and U.S. Patent Application Pub. No. 20070251874 to Stewart. The use of highly flexible straining membranes (such as plastic bags) to drain liquids from articles has also been use proposed, such as in U.S. Patent Application Pub. No. 20110274807 to Haber.

Despite numerous types of washing and drying racks, there are various drawbacks with current baby feeding article washing and drying apparatuses. A significant drawback of current apparatuses is that they are limited in the types of locations where the apparatus can be placed. Some apparatuses require a hook, some require a basin, some are not easily collapsible or portable, and others take up too much space. The disadvantages of the current washing and drying apparatuses can be frustrating to the traveling parent who needs an easily portable apparatus that can placed in a variety of locations. Therefore, there remains a need to improve baby feeding article washing and drying apparatuses so that they are collapsible, maintain sanitary conditions, take a minimum amount of space when assembled, and can be hung or laid in a variety of locations, such in a sink, a towel bar, a curtain rod, or a hook. One skilled in the art will recognize many other benefits of this new portable washing and drying apparatus.

SUMMARY OF THE INVENTION

The present invention relates to a portable washing and drying apparatus, especially useful for washing and drying baby bottle components and other baby feeding accessories. The present invention provides a washing and drying apparatus that can be collapsed, expanded, folded, set in a sink, or hung on an external support. Accordingly, it is an object of the present invention to provide an apparatus and method to wash and dry baby feeding articles that is sanitary and can be used in locations where there is little or no space to place baby feeding. It is a further object of the present invention to provide an apparatus that can conform to various shapes, sizes, and types of sinks. Yet another object of the invention to provide structures to easily hang a washing and drying apparatus. Various embodiments of the present invention have one or more advantages over the prior art, which include: (1) increased sanitation of baby feeding supply articles because the articles do not directly touch a sink or counter, (2) ability to wash and dry baby feeding articles in locations where there is minimal space, such as hotel rooms that do not have a kitchen, (3) increased ability to adjust the size of the washing and drying receptacle that holds the baby-feeding articles, and (4) increased portability due to lightweight and foldable properties so the apparatus can easily fit in a diaper bag or luggage.

In a preferred embodiment, the portable washing and drying apparatus comprises a flexible membrane, substantially rigid elongated frame members, and a coupling member. The flexible membrane has a top surface, a bottom surface, and a central region sounded by a perimeter. The flexible membrane has a plurality of holes interspersed through the central region to permit liquid to drain from it. The flexible membrane also has a plurality of projections interspersed throughout the central region. The plurality of projections extend from the top surface of the flexible member and are designed to retain drying items placed over the plurality of projections. Preferably there are a first and a second substantially rigid elongated frame members. The substantially rigid elongated frame members oppose each other and are on opposite sides of the perimeter of the flexible membrane. At least one of the substantially rigid frame members has a plurality of frame projections extending substantially perpendicularly therefrom, so that the articles are held upright or upside down on the frame projections to help dry articles or to hold the articles upright when the user want to soak the articles.

The coupling member (a hook for example) is connected directly or indirectly to at least one of the substantially rigid elongated frame members. The coupling member is designed to couple at least one of the frame members to an external support structure such as a towel bar or curtain rod. The flexible membrane is designed to substantially conform to a surface contour (such as the concave contour of a sink basin). The flexible membrane maintains a concave shape when suspended by the substantially rigid elongated frame members, and the flexible membrane has properties that allow the frame members to move toward or away from each other, thus allowing the overall span of the apparatus to be adjustable.

In one embodiment the frame projections are arranged radially so a baby bottle can be held upright between the frame projections. In yet another embodiment, there is at least one partition barrier located on the top surface of the central region of the flexible membrane to prevent items placed on one side of the partition barrier from migrating to the other side of the partition barrier.

In another embodiment, the coupling member directly attaches to each of the frame members, while in different embodiments, the coupling member is attached to a rope, chain, or other elongated flexible member, and the elongated flexible member is attached to both substantially rigid elongated frame members so that the apparatus can hang from a single coupling member to an external support structure, such a towel bar or curtain rod.

In yet another embodiment, the projections of the flexible membrane and/or partition barriers are detachable, and are capable of pivoting away from the flexible membrane at various angles.

In yet another embodiment, there are third and fourth substantially rigid elongated frame members. The third and fourth substantially rigid elongated frame members oppose each other, are parallel to each other. The third and fourth substantially rigid elongated frame members are connected to the first and second substantially rigid elongated frame members (thereby forming a rectangular overall frame shape, each side of the overall frame formed by one of the rigid elongated frame members, with the flexible membrane in the middle of the frame members). In one embodiment of the third and fourth rigid elongated frame members there are folding joints that allow the apparatus to fold into a collapsed state.

BRIEF DESCRIPTION OF THE DRAWINGS

The above and various other objects and advantages of the invention will be described and understood from the following description of the preferred embodiments of the invention, the same being illustrated in the accompanying drawings.

DETAILED DESCRIPTION OF THE INVENTION

Figure 1:
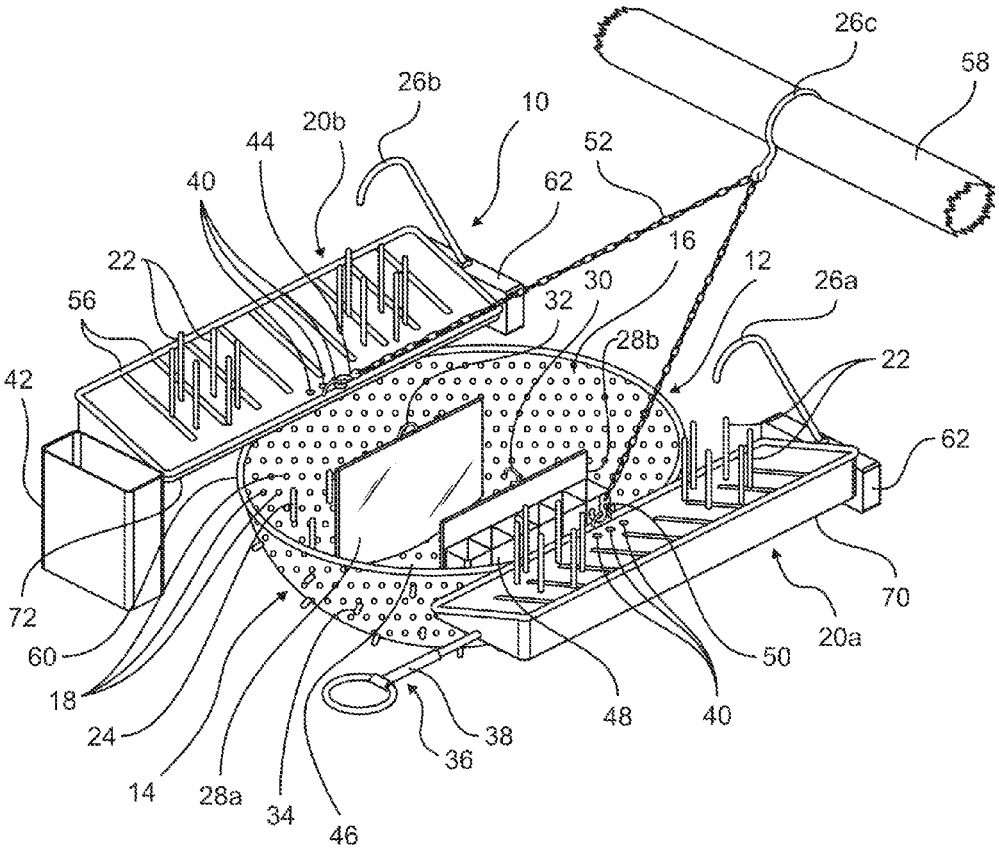
FIG. 1 is a perspective view of one embodiment of the portable washing and drying apparatus.

The following description is of the best-contemplated mode of carrying out the invention. This description is made for the purpose of illustrating the general principles of the invention and should not be taken in a limiting sense. The scope of the invention is best determined by reference to the appended claims. Preferable embodiments of the present invention are described with reference to FIGS. 1-3.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section.

As used herein, the singular forms "a," "an," and "the," are intended to include the plural forms as well, unless the context clearly indicates otherwise. It will be further understood that the terms "comprises," "comprising," "includes," "including," "have" and "having," when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," and "upper" or "top," and "inner" or "outer," may be used herein to describe one element's relationship to another elements as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Ranges may be expressed herein as from "about" or "approximately" one particular value and/or to "about" or "approximately" another particular value. When such a range is expressed, another embodiment includes from the one particular value and/or to the other particular value.

All of the U.S. patents and patent application publications, foreign patents and foreign patent application publications, and non-patent publications referred to in this specification and/or listed in the Application Data Sheet, are incorporated herein by reference, in their entireties.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing.

Figure 2:
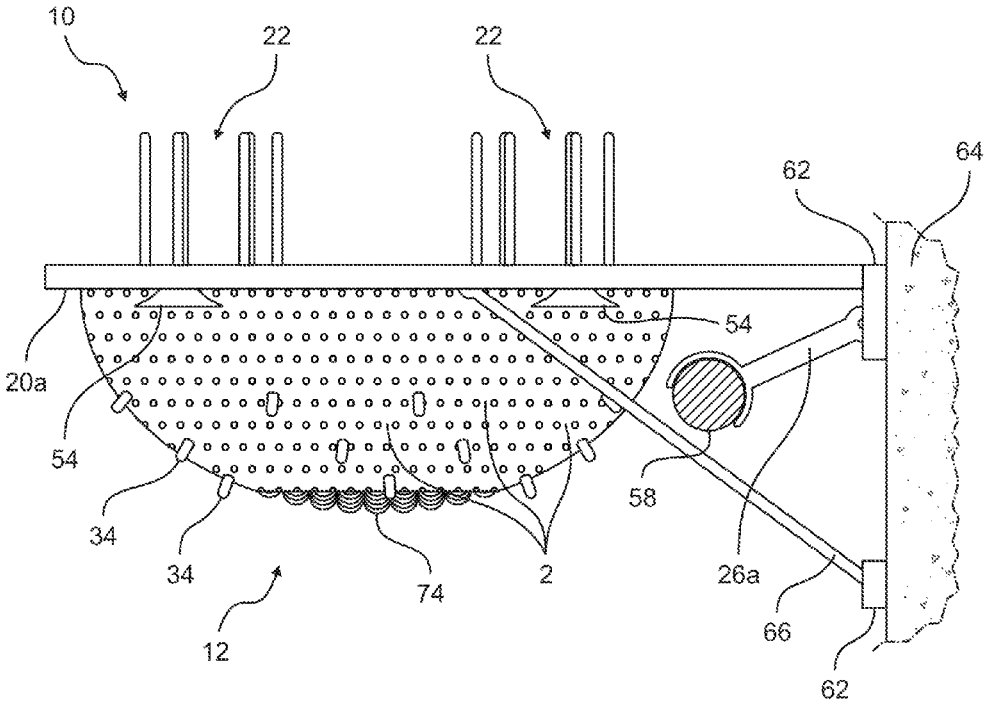
FIG. 2 is a side view of a different embodiment of the portable washing and drying apparatus having alternative coupling and bracing members as well as a coiled membrane region.

Referring now to the illustrations, FIG. 1 depicts an embodiment of a portable washing and drying apparatus 10. The apparatus 10 has a flexible membrane 12. The membrane 12 has a top surface 16, bottom surface 14, and a central region 46 surrounded by a perimeter 60. The membrane 12 may be made from any number of suitable materials that are flexible and/or elastic, such as rubber, polyurethane, neoprene, silicone, natural or synthetic polymers and fibers, and may defined as a type of sheet, mat, or mesh. Types of flexible materials that may be used for the membrane are disclosed in U.S. Patent Application Pub. No. 20110274807, entitled "Elastomeric multi-function squeezer/strainer device." The membrane 12 should have properties that allow the membrane 12 to easily conform to the shape of the surface that the membrane 12 lies on. The membrane 12 can also be a net-like or meshed structure that allows liquids to drain through the holes of the net or mesh. The elastomeric properties of the membrane 12 should allow the membrane to support numerous baby-feeding supply articles without tearing. In one embodiment the hardness of the membrane 12 has a Shore scale hardness between 10A and 30A. These properties may vary depending on the thickness of the membrane 12 used. In another embodiment, the elastomeric properties of the membrane 12 may be accomplished using coils 74. The coils 74 may be in various regions of the membrane 12, such as between partition members 28*a*, 28*b* (as shown in FIG. 2 in side view, where the central nadir of the membrane 12 is coiled). A coiled region of the membrane 12 allows for additional flexibility to be localized to specific regions of the membrane 12, which allows the apparatus 10 to better adjust to the shape and size of a sink or other basin. Other embodiments may have the coiled region 74 primarily about the perimeter 60 of the membrane 12 instead of the central region of the membrane 12. Coils 74 of the membrane may be characterized as similar to coils on telephone cords, which are disclosed by U.S. Pat. No. 2,173,096 to Campbell and U.S. Patent Application No. 20090104811 to Sumida. The membrane 12 has a plurality of holes 18 interspersed throughout the central region 46. These holes 18 allow water to drain from inside the membrane 12 to outside the membrane 12.

To prevent the membrane 12 from contacting a surface directly, such as the basin of a sink, a plurality of legs 34 project from the bottom surface 14 of the membrane 12. When placed in a basin, these legs 34 slightly raise the membrane 12 from the surface of the basin. This structure not only aids in improving water drainage, but is more sanitary since the membrane 12 will not touch a contaminated surface directly.

The flexible membrane 12 may also have partition barriers 28*a*, 28*b*. The partition barriers separate the flexible membrane 12 into different regions. When two partition barriers 28*a*, 28*b* are used, the membrane 12 is partitioned into left, central, and right regions. Baby feeding articles placed in the left or right region would be prevented from falling into the central region 46 when the partition barriers 28*a*, 28*b* are erected and extend from the flexible membrane 12. In this configuration, the central region can be used for washing, while the left and right region can retain items for drying. The partition barriers 28*a*, 28*b* preferably are parallel to each other and run substantially along length or width of the membrane 12. The partition barriers 28*a*, 28*b* may have features such a plurality of elongated open top compartments 48 that can hold utensils, or straws. The compartments 48 may have bottom openings or holes that allow liquid from the utensils to drain away. The partition barriers 28*a*, 28*b* can also be variably adjusted to be closer together, which would reduce the size of the receptacle formed by the flexible membrane 12. This adjustment of the distance between the partition barriers 28*a*, 28*b* may be through the use the use of partition barrier connection members 30, 32 that secure the first partition barrier 28*a* to the second partition barrier 28*b*. The first partition barrier 28*a* may have a first partition barrier connection member 32, such as a loop, and the second partition barrier 28*b* may have a second partition barrier connection member 30, such as a hook. The two partition barriers 28*a*, 28*b* can also be connected via other means, such as through latches, magnets, snaps, ties, or Velcro®. When the loop 32 and hook 30 are connected, the span the apparatus 10 is reduced and the apparatus 10 can lie or hang in compact spaces.

Along the top surface 18 of the membrane 12 are a plurality membrane projections 24. These membrane projections 24 may be of a variety of sizes and shapes to hold specific types of items, such as bottle nipples, bottle filters, pacifiers, etc. The membrane projections 24 may be detachable and also pivotable so that they can be variably angled from the membrane 12.

The flexible membrane 12 is supported by first and second substantially rigid elongated frame members 20*a*, 20*b*. The frame members can lie on a sink counter or can be suspended by one or more coupling members 26*a*, 26*b*, 26*c*. The frame members 20*a*, 20*b* can extend over the edge of a sink are able to hold numbers bottles on each side. These frame members 20*a*, 20*b* substantially oppose and are substantially parallel to each other. The frame members 20*a*, 20*b* may have surface holding members such as suction cups 54 that hold the apparatus 10 securely when on a bathroom or kitchen sink counter. In scenarios where there is no sink counter, but only sink basin (such as a pedestal sink), the suction cups 54 may also attach directly to a sink basin rim. The frame members 20*a*, 20*b* are connected to the flexible membrane 12 on opposing sides of the perimeter 60. Due to the flexibility of the membrane 12, the frame members 20*a*, 20*b* can be adjustably moved toward or away from each other, thereby allowing the apparatus 10 to be used in basins having various sizes and shapes.

The frame members 20*a*, 20*b* may be made from a variety of materials, but in a preferred embodiment are made from a rigid plastic. The frame members 20*a*, 20*b* have several features that are advantageous for drying items. One feature is that the frame members 20*a*, 20*b* have plurality of frame member projections 22. These may be arranged radially so that the projections or tines 22 fit around the circumference of baby bottle. In a preferred embodiment, the circumference of the projections 22 would be large enough to hold the widest common baby bottle on the market. This region within the radially arranged projections 22 provide a sanitary space to both allow bottles to soak with soap and water when the bottles are placed in an upright position, and also allow baby bottles to dry when placed in an upside down position. There may be numerous arrangements of the projections 22. Some arrangements may be radial, such as the one illustrated in FIG. 1, both other arrangements may be linear. The projections 22 can be of a variety of heights and widths.

The frame members 20*a*, 20*b* may have additional features that are advantageous for cleaning baby feeding supply articles. These include a bottle brush holding member 36, which preferably is a ring shaped member. The bottle brush holding member 36 may be attached to one of the frame members 20*a*, 20*b* by an arm 38. The arm 38 preferably is a telescoping arm that allows the user to extend the bottle brush holding member 36 out away from the frame member 20*a*, 20*b* so that a brush can hang over the sink counter. Another feature includes a sponge holding receptacle 42. In alternate embodiments, the bottle brush holding member 36 and sponge holding receptacle 42 can hang above the membrane 12.

Another feature advantageous for drying are that the frame members 20*a*, 20*b* may have ribs 56 that form grooves along the frame members 20*a*, 20*b*. The ribs 56 keep the rim of bottles elevated (preferably 2 mm or more) to allow water to flow out and air to flow in, while drying. In a preferred embodiment, the frame members 20*a*, 20*b* would have an outer edge 70 having a higher elevation than an inner edge 72 of the frame members 20*a*, 20*b*. This feature allows water to drain from the outer edge 70 to the inner edge 72 and out through frame member holes 40 that allow water to drain off of the frame members 20*a*, 20*b*.

Figure 3:
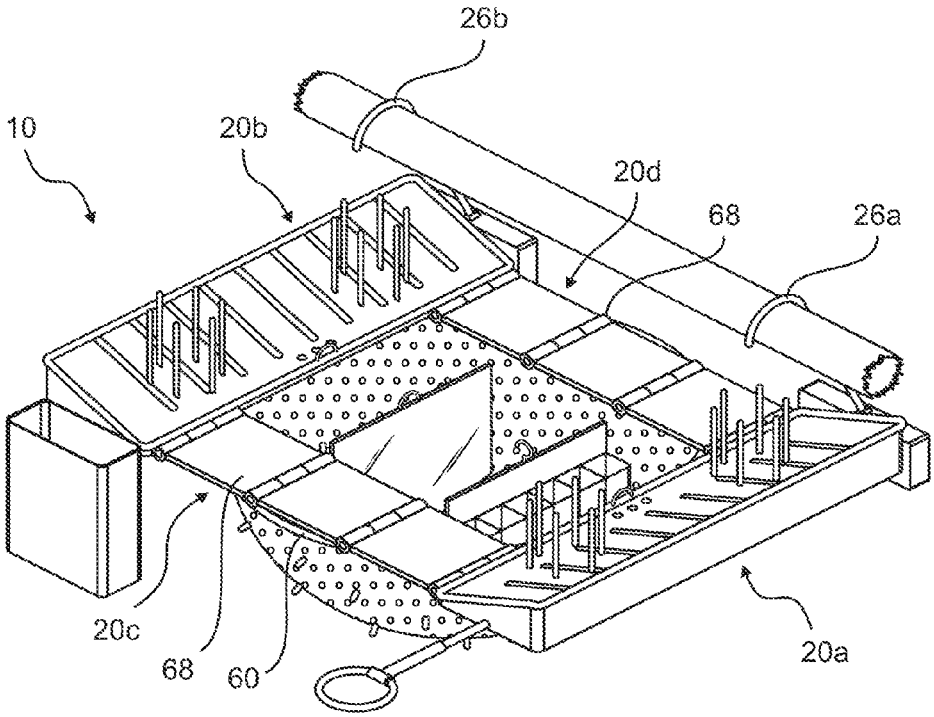
FIG. 3 is a perspective view of an embodiment of the portable washing and drying apparatus having foldable frame members.

Although the apparatus 10 may be laid in a sink, when sink placement is not an option, the apparatus 10 may be hung by several different methods using various coupling means. A coupling member 26*a*, 26*b*, 26*c* may latch onto one or more types of external supports 58, such as a towel bar or curtain rod. In a preferred embodiment the coupling member 26*a*, 26*b*, 26*c* is a hook, but other types of coupling members that may be used include latches, magnets, snaps, or Velcro® (hook and loop). In one embodiment, two coupling member 26*a*, 26*b* are attached to respective frame members 20*a*, 20*b*. The coupling members 26*a*, 26*b* may hook over the towel bar or shower rod 58 and the apparatus 10 hangs from towel bar 58 that is secured to a wall 64. The coupling members 26*a*, 26*b* may be spring loaded or stretchy so that the coupling members 26*a*, 26*b* can tightly grasp a towel bar 58. FIG. 3 illustrates the apparatus 10 hanging from coupling members 26*a*, 26*b* on a towel bar. In this embodiment, the coupling members 26*a*, 26*b* can pivot down and be positioned lateral to the frame members 20*a*, 20*b*, when the apparatus 10 is assembled for washing (i.e. not in a hanging position). The frame members 20*a*, 20*b* may have a bumper 62 that helps maintain the apparatus 10 against a wall in a perpendicular position. The apparatus 10 can also be maintained perpendicular to a wall 64 by several other means. U.S. Pat. No. 7,412,692 discloses a "Stowable shelf/rack assembly" that has lower frame members connected to coupling members that brace the assembly against a wall. Other structures that allow the apparatus 10 to extend vertically from a wall 64 are illustrated in FIGS. 2 and 3 and described below. One or more of these types of coupling members 26*a*, 26*b*, 26*c* can be used alone or in combination with the apparatus 10 as different coupling members 26*a*, 26*b*, 26*c* would be suitable for different hanging scenarios.

FIG. 2 illustrates a side view of an embodiment of the apparatus 10 that has various structures to brace the apparatus 10 against a wall 64. One structure is a retractable extension leg 66, which acts in the same manner as a kickstand, by bracing the apparatus 10 against the wall. The retractable leg 66 is adapted to retract along at least the frame members 20*a*, 20*b* in its retracted position, and extend away the frame members 20*a*, 20*b* toward a wall, in its extended position.

The coupling members 26*a*, 26*b* may extend below the frame members 20*a*, 20*b* which brace the apparatus 10 against the wall 64. One or more of these bracing members 66 may include a bumper 62 that adds frictional support so that the apparatus 10 can be placed against a wall 64 on a towel bar 58, and not slip, thereby maintaining a substantially perpendicular orientation to the wall 64.

The coupling members 26*a*, 26*b* may have features such as bumper 62, which may be made of rubber or other high frictional coefficient material, that may be attached to the substantially rigid elongated members 20*a*, 20*b*, the coupling member 26*a*, 26*b*, or both. A spring-loaded arm of the coupling member 26*a*, 26*b* is another structure that would increase fraction between the coupling members 26*a*, 26*b* and bar 58, so that the coupling members 26*a*, 26*b* are capable of grabbing the bar 58 tightly.

Returning to FIG. 1, when a bar 58 that is attached to a wall is not available, the user may hang the apparatus 10 from a single coupling member 26*c* that is attached to an elongated flexible member 52 such as a chain, rope or cord. The single coupling member 26*c* may be secured to other types of bars 58 like a shower rod 58, that would allow for free hanging of the apparatus 10 without the need for a bracing support of a wall. The chain 52 secures to opposing sides of the apparatus 10, preferably on the frame members 20*a*, 20*b*. Preferably, the chain 52 has chain coupling members 50 that secure to frame coupling members 44, such as loops which are attached to the frame member 20*a*, 20*b*. This arrangement of a chain 52 attached to frame coupling members 44 allow the apparatus 10 to hang down from a single coupling member 26*c* and would be advantageous for hanging the apparatus 10 from an external support member 58 such as a shower curtain rod.

FIG. 3 is a perspective view of an embodiment of the apparatus 10 where the apparatus 10 has a third substantially rigid elongated frame member 20*c* and a fourth substantially rigid elongated frame member 20*d*. The third and fourth frame members 20*c*, 20*d* are substantially opposed to each other and substantially parallel to each other. The third and fourth frame members 20*c*, 20*d* are perpendicularly connected to the first and second frame members 20*a*, 20*b*, thereby forming a substantially rectangular frame around the perimeter 60 of the flexible membrane 12. The third and fourth frame members 20*c*, 20*d* each have at least one frame member folding joint 68, which allows the apparatus 10 to be folded into a collapsed state as the first and second frame members 20*a*, 20*b* are brought in toward each other. The individual features of the embodiments illustrated and described in FIGS. 1-3 may be found individually on the apparatus 10, or in any combination with each other.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations that fall within the spirit and broad scope of the appended claims.

I claim:

1. A portable washing and drying apparatus comprising:

a) a flexible membrane having a top surface, a bottom surface, and a central region surrounded by a perimeter, wherein said flexible membrane has:

i) a plurality of holes interspersed throughout the central region to permit liquid to drain from said flexible membrane, and ii) a plurality of projections interspersed throughout the central region, said plurality of projections extending from the top surface of the flexible membrane designed to retain drying items placed over the plurality of projections;

b) a first substantially rigid elongated frame member and an opposing second substantially rigid elongated frame member, said first and second substantially rigid elongated frame members connected to opposing sides of the perimeter of the flexible membrane, and wherein at least one of said first and second substantially rigid elongated frame members has a plurality of frame projections extending substantially perpendicularly therefrom to place articles over or within the frame projections;

c) at least one coupling member connected directly or indirectly to at least one of said first and second substantially rigid elongated frame members, said coupling member designed to couple at least one of said first and second substantially rigid elongated frame members to an external support structure;

wherein said flexible membrane is designed to substantially conform to a surface contour when said flexible membrane rests upon the surface contour, and wherein said flexible membrane maintains a concave shape when suspended from said first and second substantially rigid elongated frame members above a surface; and, wherein said flexible membrane is characterized as having a flexibility that allows said first rigid elongated frame member to have an adjustable distance from said second elongated frame member.

2. The portable washing and drying apparatus of claim 1 further comprising:

a plurality of legs extending from the bottom surface of the flexible membrane, whereby said plurality of legs prevent said flexible membrane from directly contacting a surface.

3. The portable washing and drying apparatus of claim 1, further comprising:

at least one partition barrier partitioning said central region of the flexible membrane into a first central region and a second central region, whereby said at least one partition barrier prevents articles placed within the first central region from migrating to the second central region.

4. The portable washing and drying apparatus of claim 3 wherein said at least one partition barrier comprises a plurality of retaining compartments for retaining utensils.

5. The portable washing and drying apparatus of claim 1 further comprising a retaining arm attached to at least one of said first and second rigid elongated frame members, said retaining arm capable of retaining a bottle scrubbing brush.

6. The portable washing and drying apparatus of claim 1, wherein said flexible membrane is characterized as have a meshed or coiled region.

7. The portable washing and drying apparatus of claim 1, wherein said plurality of frame projections are characterized as having a radial arrangement designed to retain a bottle placed upright and substantially in a center of said radial arrangement of said frame projections.

8. The portable washing and drying apparatus of claim 1 further comprising:

an elongated flexible member secured to said first and second rigid elongated frame member, wherein said coupling member is disposed along said elongated flexible member.

9. The portable washing and drying apparatus of claim 8, wherein said elongated flexible member is a chain and said coupling member is a hook.

10. The portable washing and drying apparatus of claim 1 wherein at least one of said first and second substantially rigid elongated frame members comprises a retractable extension leg, wherein said retractable extension leg is adapted to retract along said at least one of said first and second substantially rigid elongated frame members and extend away from said at least one of said first and second substantially rigid elongated frame members.

11. The portable washing and drying apparatus of claim 10, wherein said retractable extension leg comprises a bumper adapted to frictionally brace said retractable extension leg against a wall.

12. The portable washing and drying apparatus of claim 1, wherein at least one of said first and second rigid elongated frame members comprises a bumper adapted to frictionally brace said at least one of said first and second rigid elongated frame members against a wall.

13. The portable washing and drying apparatus of claim 1, wherein said at least one coupling member is a first and second coupling member, each of said first and second coupling member connected to said first and second substantially rigid elongated frame members, respectively.

14. The portable washing and drying apparatus of claim 3, wherein said at least one partition barrier is a first partition barrier and a second partition barrier, wherein said first partition barrier comprises a connection member to secure said first partition barrier to said second partition barrier, thereby reducing a span of the portable washing and drying apparatus.

15. The portable washing and drying apparatus of claim 3, wherein said plurality of projections of the flexible membrane are detachable and capable of projecting at variable angles from the top surface of the flexible membrane, and wherein said partition barrier is detachable and capable of projecting at variable angles from the top surface of the flexible membrane.

16. The portable washing and drying apparatus of claim 1, further comprising:

a third substantially rigid elongated frame member and an opposing and substantially parallel fourth substantially rigid elongated frame member;

said third and fourth substantially rigid elongated frame members connected to opposing sides of the perimeter of the flexible membrane, and each of said third and fourth substantially rigid elongated frame members connected to said first and second rigid elongated frame members;

said third and fourth substantially rigid elongated frame members each having a folding joint, thereby allowing a user to fold the portable washing and drying apparatus into a collapsed state.

17. The portable washing and drying apparatus of claim 1, wherein at least one of said first and second substantially rigid elongated frame members comprises raised ribs extending from a top surface of said first and second elongated frame members, said raised ribs configured to elevate a baby-feeding article to increase air flow into the baby-feeding article;

wherein at least one of said first and second rigid elongated frame members is characterized as having an outer edge having a higher elevation than an inner edge, thereby permitting water to migrate to the inner edge; and, wherein at least one of said first and second rigid elongated frame members comprises holes to permit draining of liquid.

18. A portable washing and drying apparatus comprising:

a) a flexible membrane having a top surface, a bottom surface, and a central region surrounded by a perimeter, wherein said flexible membrane has:

i) a plurality of holes interspersed throughout the central region to permit liquid to drain from said flexible membrane, and ii) a plurality of projections interspersed throughout the central region, said plurality of projections extending from the top surface of the flexible membrane designed to retain drying items placed over the plurality of projections, b) a first substantially rigid elongated frame member and an opposing second substantially rigid elongated frame member, said first and second substantially rigid elongated frame members connected to opposing sides of the perimeter of the flexible membrane, and wherein at least one of said first and second substantially rigid elongated frame members has a plurality of frame projections extending substantially perpendicularly therefrom to retain drying items placed over the frame projections, a third substantially rigid elongated frame member and an opposing and substantially parallel fourth substantially rigid elongated frame member, said third and fourth substantially rigid elongated frame members connected to opposing sides of the perimeter of the flexible membrane, and each of said third and fourth substantially rigid elongated frame members connected to said first and second rigid elongated frame members, said third and fourth substantially rigid elongated frame members each comprising a folding joint, thereby allowing a user to fold the portable washing and drying apparatus into a collapsed state;

c) a coupling member connected directly or indirectly to at least one of said first and second substantially rigid elongated frame members, said coupling member designed to couple at least one of said first and second substantially rigid elongated frame members to an external support structure;

wherein said flexible membrane is designed to substantially conform to a surface contour when said flexible membrane rests upon the surface contour, and wherein said flexible membrane maintains a concave shape when suspended from said first and second substantially rigid elongated frame members above a surface; and, wherein said flexible membrane is characterized as having a flexibility that allows said first rigid elongated frame member to have an adjustable distance from said second substantially elongated frame member.

* * * * *